US005484137A

United States Patent [19]

Smith

[11] Patent Number: 5,484,137

[45] Date of Patent: Jan. 16, 1996

[54] PORTABLE LINE BARRIER

[76] Inventor: Franklin D. Smith, 1809 N. Flagler Dr. D-5, West Palm Beach, Fla. 33407

[21] Appl. No.: 241,344

[22] Filed: May 11, 1994

[51] Int. Cl.[6] ..... E04H 17/00; E01F 9/00

[52] U.S. Cl. ..... 256/50; 256/1; 256/46; 116/202

[58] Field of Search ..... 256/50, 1, 46, 256/34; 116/202, 63 P; 224/45.45 R, 42.42; 362/253, 190, 191, 196, 431, 410, 414, 411; 340/473, 908.1, 321; 403/109

[56] References Cited

U.S. PATENT DOCUMENTS

| | | | |
|---|---|---|---|
| 2,508,071 | 5/1950 | Martin et al. | 340/473 X |
| 2,781,017 | 2/1957 | Fuller et al. | 116/63 P |
| 3,917,231 | 11/1975 | Fink | 256/1 X |
| 3,977,654 | 8/1976 | Etherington et al. | 256/1 X |
| 4,096,552 | 6/1978 | Ben-Porat | 362/190 X |

FOREIGN PATENT DOCUMENTS

| | | | |
|---|---|---|---|
| 926647 | 10/1947 | France | 116/63 P |
| 287600 | 3/1928 | United Kingdom | 116/202 |

*Primary Examiner*—Anthony Knight

[57] ABSTRACT

A portable line barrier including a plurality of telescopically extendable poles. Further provided are a pair of line payer heads. Each line payer head is coupled to a separate pole and each head has a container with a hollow interior and a closeable opening for allowing access to the interior. A spool is disposed within the interior of the container and is rotatably coupled to the container. A plurality of loops with each loop are coupled to a separate pole which is not coupled to a line payer head. Each loop is adapted for holding a cable within. A cable which has one end coupled to and wrapped around the spool of one of the line payer heads is included. Another end extends through the loops of the poles and is coupled to and wrapped around the spool of the other line payer head such that the poles, line payer head, and loops create an extendable barrier. Therefore, when the cable is extended between the line payer heads and the poles are positioned on a surface in a spaced relationship, the barrier is placed in an operable configuration.

3 Claims, 4 Drawing Sheets

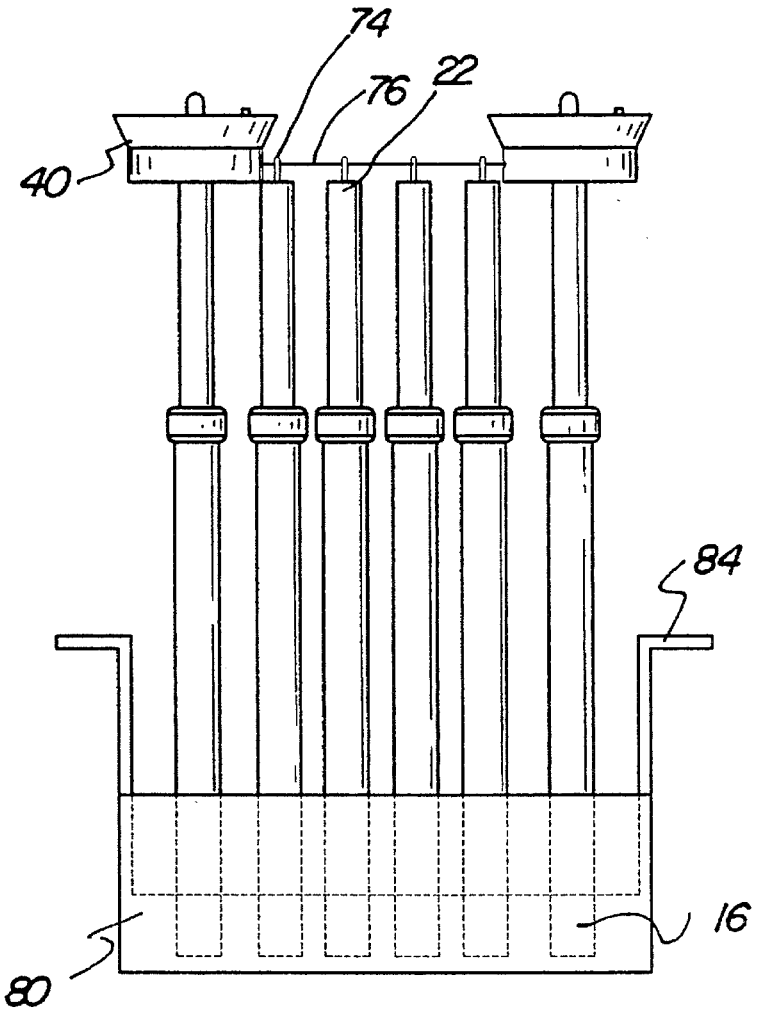
Fig. 7
Fig. 8
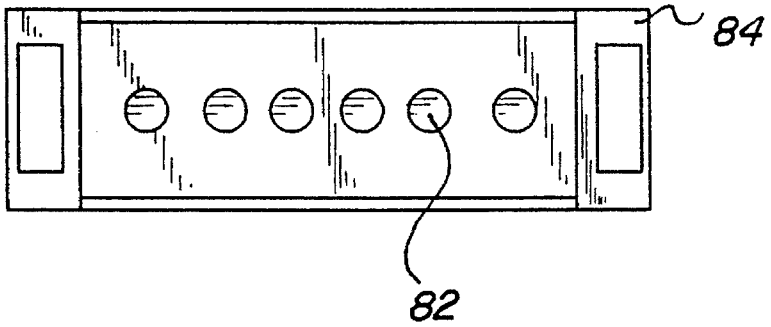

PORTABLE LINE BARRIER

BACKGROUND OF THE INVENTION

1. Field of the Invention

The present invention relates to a portable line barrier and more particularly pertains to preventing people from accessing a particular area with a portable line barrier.

2. Description of the Prior Art

The use of barriers is known in the prior art. More specifically, barriers heretofore devised and utilized for the purpose of controlling access by people are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,688,440 to Applegarth et al. discloses a portable barricade. U.S. Pat. No. 4,524,953 to Phillips et al. discloses an adjustable protective rope barrier. U.S. Pat. No. 4,765,277 discloses a telescopic pole system. U.S. Pat. No. 4,844,420 to Oster discloses a retractable crowd control barrier. U.S. Pat. No. 4,958,807 to Wylie discloses decorative posts for crowd control.

While these devices fulfill their respective, particular objective and requirements, the aforementioned patents do not describe a portable line barrier that is portable in design, is readily placed in an extended or stowed configuration, and has flashing lights disposed thereon for providing an indicative warning.

In this respect, the portable line barrier according to the present invention substantially departs from the conventional concepts and designs of the prior art, and in doing so provides an apparatus primarily developed for the purpose of preventing people from accessing a particular area.

Therefore, it can be appreciated that there exists a continuing need for new and improved portable line barrier which can be used for preventing people from accessing a particular area. In this regard, the present invention substantially fulfills this need.

SUMMARY OF THE INVENTION

In the view of the foregoing disadvantages inherent in the known types of barriers now present in the prior art, the present invention provides an improved portable line barrier. As such, the general purpose of the present invention, which will be described subsequently in greater detail, is to provide a new and improved portable line barrier and method which has all the advantages of the prior art and none of the disadvantages.

To attain this, the present invention essentially comprises, in combination, six rigid outer poles with each outer pole having a threaded upper end and a weighted lower end with each lower end adapted to rest on a generally level surface to place each outer pole in a generally upright position. Six rigid inner poles are included with each inner pole having an upper end and a lower end with each lower end slidably received in a separate upper end of an outer pole such that each inner pole is telescopically extendable with respect its associated outer pole. Six rigid collars are included with each collar threadably coupled about an upper end of a separate outer pole and its associated inner pole, whereby tightening a collar sets the extension of an inner pole with respect to its outer pole and loosening a collar allows adjustment of an inner pole with respect to its associated outer pole.

A pair of line payer heads are included with each line payer head coupled to a separate upper end of a separate inner pole. Each line payer head includes a rigid and generally cylindrical top section having a lower surface and a peripheral and outwardly tapered side wall extended upwards therefrom to define an opening. Each line payer head includes a rigid and generally circular cover threadably coupled to the top section over the opening to define a first compartment. Each line payer head includes a rigid and generally cylindrical bottom section having a lower surface and a peripheral side wall extended upwards therefrom and threadably coupled to the lower surface of the top section to define a second compartment. Each line payer head includes a pivot pin centrally disposed in the second compartment having one end coupled to the lower surface of the bottom section and another end extended upwards therefrom. Each line payer head includes a spool rotatably disposed about the pivot pin within the second compartment. Each line payer head includes an elongated and coiled spring disposed about the pivot pin with the spring having one end coupled to the pivot pin and another end coupled to the spool with the spring adapted for urging the spool into a position such that the radial extension of the spring is minimal. Each line payer head includes a lamp coupled to the cover with a portion thereof extended into the first compartment. Each line payer head includes a battery disposed within the first compartment and coupled to the lamp with the battery adapted for providing energy for illuminating the lamp. Each line payer head includes a switch coupled between the battery and the lamp and extended through the cover with the switch having one orientation for energizing the lamp and another for de-energizing the lamp. Lastly, each line payer head includes a flasher coupled between the switch and the battery with the flasher adapted for allowing the lamp to be strobed when energized, whereby providing an indicative warning.

Furthermore, four rigid loops are included with each loop coupled to a separate upper end of four of the inner poles not having a line payer head coupled thereto. Each loop is adapted for holding a cable therein. A flexible cable is included and has one end coupled to and wrapped around the spool of one of the line payer heads and another end extended through the line payer head, through the four loops on the inner poles, through the other line payer head, and coupled to and wrapped around the its spool such that the inner poles, outer poles, collars, loops, and line payer heads create an extendable barrier. When the cable is extended between the line payer heads and the outer poles are positioned on a generally level surface in a spaced relationship, the barrier is placed in an operable configuration.

Lastly, a rigid carrying tray is included. The carrying tray has six spaced and aligned holes disposed thereon. These holes are adapted to receive the lower ends of the outer poles therein to define a stowed configuration for the barrier. The carrying tray also has a pair of handles coupled thereto and extended upwards therefrom for allowing the carrying tray to be transported from one location to another.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable line barrier which has all the advantages of the prior art barriers and none of the disadvantages.

It is another object of the present invention to provide a new and improved portable line barrier which may be easily and efficiently manufactured and marketed.

It is a further object of the present invention to provide a new and improved portable line barrier which is of durable and reliable construction.

An even further object of the present invention is to provide a new and improved portable line barrier which is susceptible of a low cost of manufacture with regard to both materials and labor, and which accordingly is then susceptible of low prices of sale to the consuming public, thereby making such a portable line barrier economically available to the buying public.

Still yet another object of the present invention is to provide a new and improved portable line barrier which provides in the apparatuses and methods of the prior art some of the advantages thereof, while simultaneously overcoming some of the disadvantages normally associated therewith.

Even still another object of the present invention is to provide a new and improved portable line barrier for preventing people from accessing a particular area.

Lastly, it is an object of the present invention to provide a new and improved portable line barrier comprising a plurality of telescopically extendable poles; a pair of line payer heads, each line payer head coupled to a separate pole, each line payer head further comprising a container having a hollow interior and an closeable opening for allowing access to the interior; and a spool disposed within the interior of the container and rotatably coupled thereto; a plurality of loops with each loop coupled to separate pole not having a line payer head coupled thereto with each loop adapted for holding a cable therein; and a flexible cable having one end coupled to and wrapped around the spool of one of the line payer heads and another end extended through the loops of the poles and coupled to and wrapped around the spool of the other line payer head such that the poles, line payer heads, and loops create an extendable barrier, whereby when the cable is extended between the line payer heads and the poles are positioned on a surface in a spaced relationship, the barrier is placed in an operable configuration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is side elevational view of the barrier disposed within the carrying tray.

FIG. 8 is a plan view of the carry tray with the barrier removed.

The same reference numerals refer to the same parts through the various Figures.

DESCRIPTION OF THE PREFERRED EMBODIMENT

Figure 1:
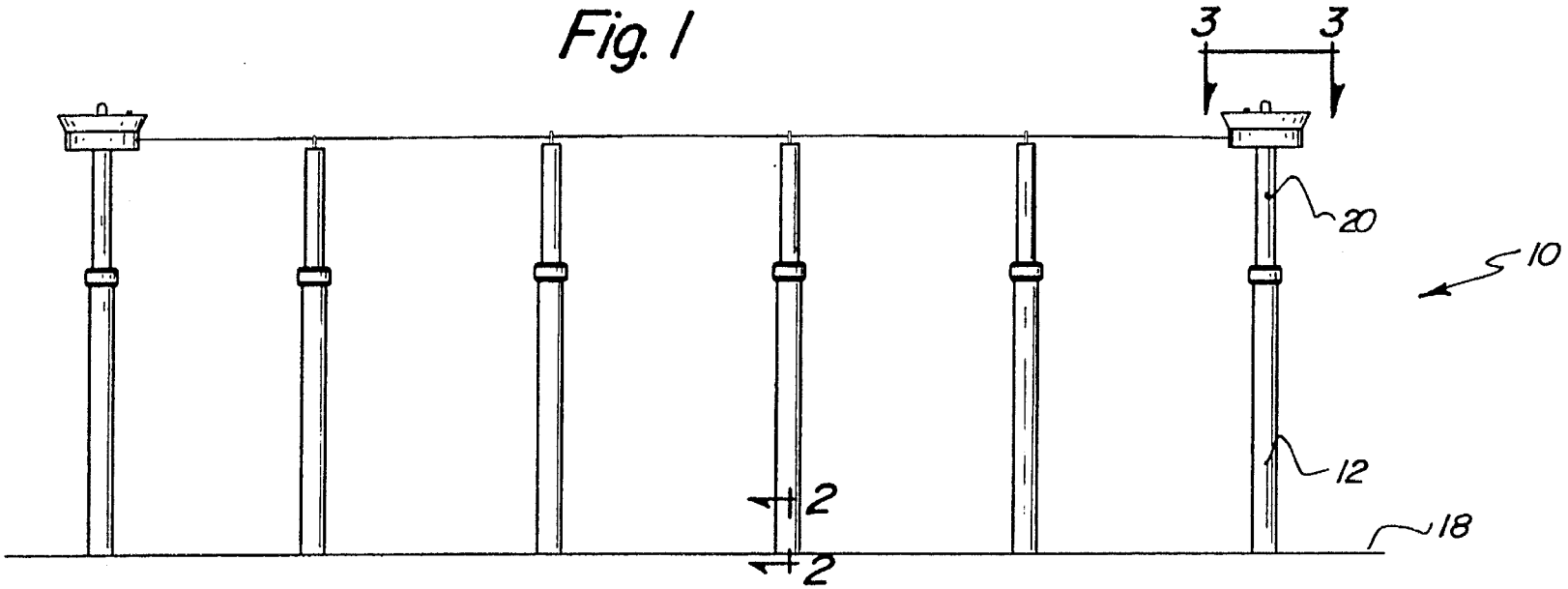
FIG. 1 is a side elevational view of the barrier with its cable extended and the lower poles placed in a spaced relationship on a generally level surface.
Figure 2:
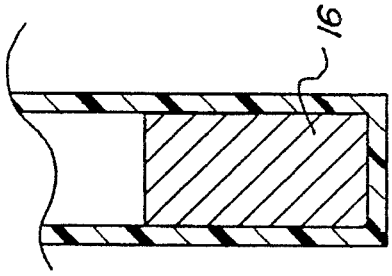
FIG. 2 is a cross-sectional view of the lower end of an outer pole taken along the line 2—2 of FIG. 1.
Figure 3:
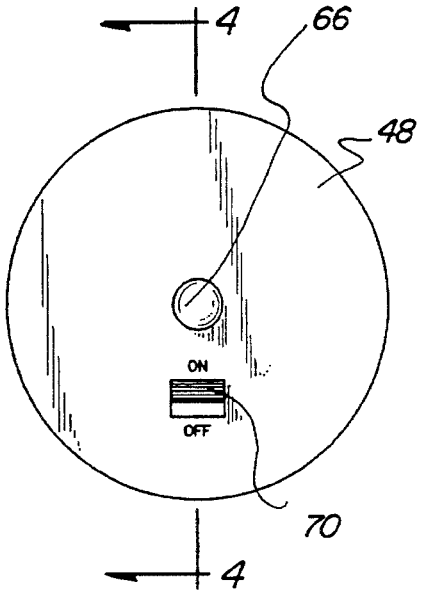
FIG. 3 is a plan view of a line payer head taken along the line 3—3 of FIG. 1.
Figure 4:
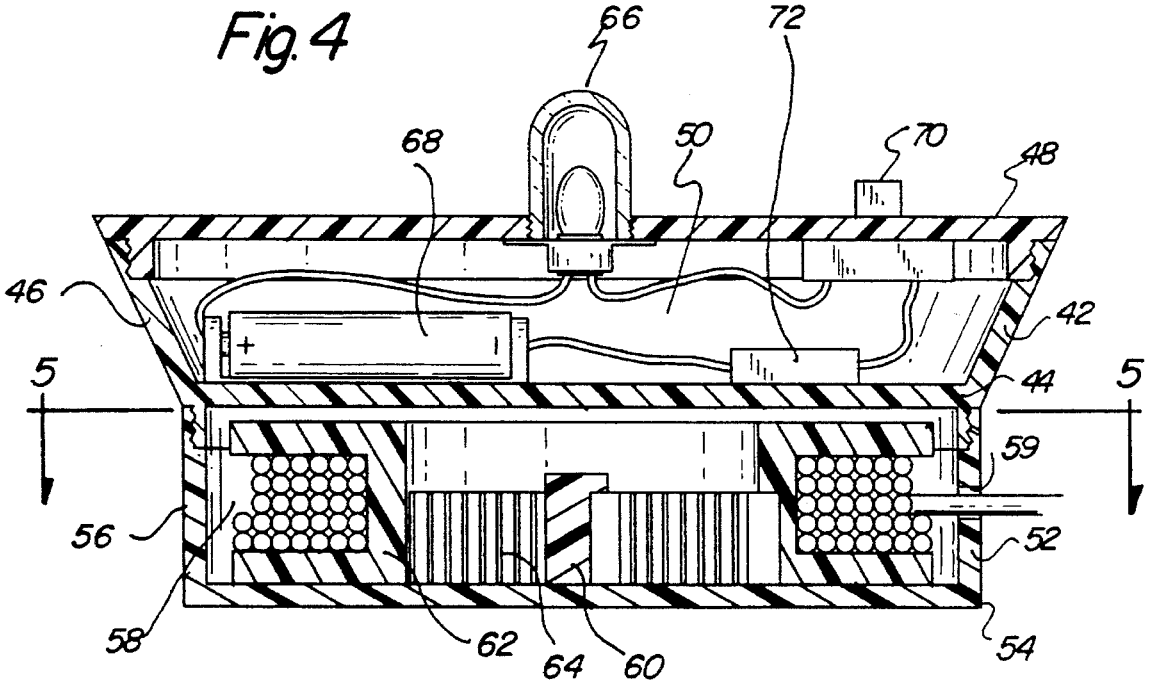
FIG. 4 is cross-sectional view of a line payer head taken along the line 4—4 of FIG. 3.
Figure 5:
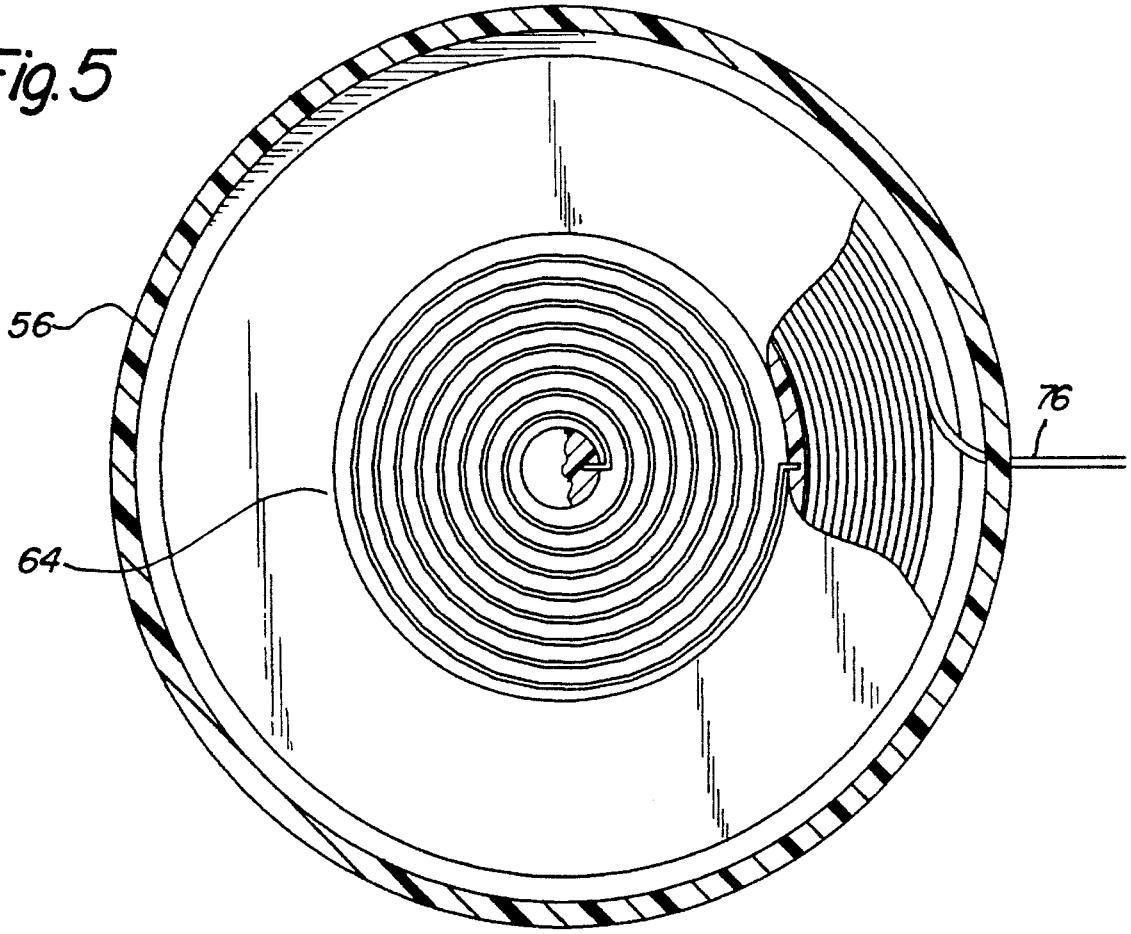
FIG. 5 is cross-sectional view of the second compartment taken along the line 5—5 of FIG. 4.
Figure 6:
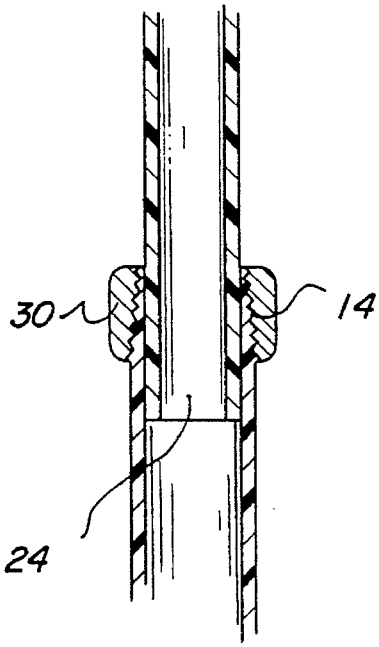
FIG. 6 is a cross-sectional view of the coupling between the inner and outer poles taken along the line 6—6 of FIG. 1.

With reference now to the drawings, and in particular, to FIG. 1 thereof, the preferred embodiment of the new and improved portable line barrier embodying the principles and concepts of the present invention and generally designated by the reference number 10 will be described.

Specifically, the present invention includes seven major components. The major components are the outer poles, inner poles, collars, line payer heads, loops, cable, and carrying tray. These components are interrelated to provide the intended function.

More specifically, it will be noted in the various Figures that the first major component is the outer poles 12. The present invention includes six outer poles. Each of the poles is rigid in structure. Each outer pole has a threaded upper end 14 and a weighted lower end 16. The weighted lower end is adapted to rest on a generally level surface 18 to place each outer pole in a generally upright position.

The second major component is the inner poles 20. The present invention includes six inner poles. The inner poles are rigid in structure. Each inner pole has an upper end 22 and a lower end 24. Each lower end is slidably received in a separate upper end 14 of an outer pole. Each inner pole is thereby telescopically extendable with respect to its associated outer pole. This telescopic configuration allows the inner pole and outer pole to be adjusted to the desired height.

The third major component is the collars 30. The present invention includes six collars. The collars are rigid in structure and have threads formed on each of their inner radial extents. The inner radial extents of each collar has a diameter. Each diameter has a decreasing radius along the radial extent. The diameter is largest at the beginning of the threads and smallest at the end of the threads along the radial extent. Each collar is threadably coupled about an upper end 14 of a separate outer pole and its associated inner pole. Rotating the collar, for coupling onto the threaded upper end, in a downwardly direction causes the upper end to tighten around the lower end of the inner pole as the radius decreases along the radial extent of the collar. By tightening the collar, the upper end of the outer pole is pressed against the lower end of the inner pole such that the extension of the inner pole 20 with respect to its outer pole is set. By loosening the collar, the upper end of the outer pole is released from the lower end of the inner pole such that the length of the inner pole with respect to its associated outer pole can be adjusted.

The fourth major component is the line payer head 40. The present invention includes a pair of line payer heads. Each line payer head is coupled to a separate upper end 22 of a separate inner pole. Each line payer head includes ten subcomponents. The subcomponents are the top section, cover, bottom section, pivot pin, spool, spring, lamp, battery, switch, and flasher. These components are interrelated to produce an operable configuration adapted for paying out cable therefrom or retrieving cable therein.

The first subcomponent of the line payer head is the top section 42. The top section is rigid and generally cylindrical in structure. It has a lower surface 44 and a peripheral and outwardly tapered side wall 46 extended upwards therefrom to define an opening. The top section is adapted for holding several of the subcomponents of the line payer head therein.

The second subcomponent of the line payer head is the cover 48. The cover is rigid and generally circular in structure. It is threadably coupled to the top section 42 over the opening. The coupling of the cover with the top section defines a first compartment 50. The cover is adapted to be readily removed from the top section for allowing access therein.

The third subcomponent of the line payer head is the bottom section 52. The bottom section rigid and generally cylindrical in structure. It has a lower surface 54 and a peripheral side wall 56. The peripheral side wall is extended upwards from the lower surface and is threadably coupled to the lower surface 44 of the top section 42. This coupling defines a second compartment 58 within the line payer head. The bottom section is adapted for holding a rotatable spool of cable. The bottom section also has a cable aperture 59 disposed therethrough for allowing cable to be payed out or retrieved.

The fourth subcomponent of the line payer head is the pivot pin 60. The pivot pin is rigid in structure. It is centrally disposed in the second compartment. The pivot pin has one end coupled to the lower surface 44 of the bottom section. The other end of the pivot pin is extended upwards towards the top section.

The fifth subcomponent of the line payer head is the spool 62. The spool is rigid and essentially annular in structure. The spool is disposed around the pivot pin 60 within the second compartment 58. The spool is adapted to have a line of cable wrapped therearound. The radial extent of the spool is essentially aligned in a horizontal plane and located near the cable aperture 59 in the bottom section for facilitating the paying out of cable that is to be wrapped around the spool.

The sixth subcomponent of the line payer head is the spring 64. The spring is elongated and coiled in structure. It is disposed about the pivot pin 60. The spring has one end coupled to the pivot pin and another end coupled to the spool. The spring is adapted for urging the spool into a position such that its radial extension is minimal. When the spool is forcibly rotated in one direction, the spring is extended. When the spool is then released, the spring is retracted, whereby causing the spool to rotate in the other direction. Through the use of the spring, the spool is thereby adapted to pay out or retract cable disposed therearound.

The seventh subcomponent of the line payer head is the lamp 66. The lamp is coupled to the cover 48. The bulb of the lamp is extended above the top cover. The terminal portion of the lamp is extended into the first compartment 50. The lamp is conventional in design and commercially available. The lamp is adapted to generate an indicative illumination signal visible by a person approaching the line payer head.

The eight subcomponent of the line payer head is the battery 68. The battery is disposed within the first compartment 50. It is coupled to the lamp 66. The battery is adapted for providing energy for illuminating the lamp. The battery is conventional in design and commercially available. The battery may be replaced by removing the cover from the top section.

The ninth subcomponent of the line payer head is the switch 70. The switch is coupled between the battery 68 and the lamp 66. The switch is extended through the cover 48 for reciprocation by a user. The switch has one orientation for energizing the lamp and another orientation for de-energizing the lamp. The switch is conventional in design and commercially available.

The tenth subcomponent of the line payer head is the flasher 72. The flasher is coupled between the switch 70 and the battery 68. The flasher is adapted for allowing the lamp to be strobed when energized. The flasher thereby allows the lamp to provide an indicative warning. The flasher is formed of conventional electronic circuitry or is available in a commercially available embodiment.

The fifth major component is the loops 74. The present invention includes four loops. The loops are rigid in structure. Each loop is coupled to a separate upper end 22 of four of the inner poles. These are the four inner poles that do not have a line payer head coupled thereto. Each loop is adapted for holding a cable therein.

The sixth major component is the cable 76. The cable is elongated and flexible in structure. The cable has one end coupled to and wrapped around the spool 62 of one of the line payer heads. Another end of the cable is extended from this line payer head, through the four loops 74 of the four inner poles, extended through the other line payer head, and coupled to and wrapped around its spool. In this couples configuration, the inner poles, outer poles, collars, loops, and line payer heads create an extendable barrier. Now, when the cable is extended between the line payer heads and the outer poles are positioned on a generally level surface in a spaced relationship, the barrier is placed in an operable configuration for preventing people from accessing a particular area.

The seventh major component is the carrying tray 80. The carrying tray is rigid in structure. It has six spaced and aligned holes 82 disposed thereon. These holes are adapted to receive the lower ends 16 of the outer poles therein. When the outer poles are disposed within the holes of the tray, the barrier is placed in a stowed configuration. The tray also includes a pair of handles 84 coupled thereto and extended upwards far allowing the carrying tray to be transported from one location to another.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A portable line barrier for preventing people from accessing a particular area comprising, in combination:

six rigid outer poles, each outer pole having a threaded upper end and a weighted lower end with each lower end adapted to rest on a generally level surface to place each outer pole in a generally upright position;

six rigid inner poles, each inner pole having an upper end and a lower end with each lower end slidably received in a separate upper end of an outer pole such that each inner pole is telescopically extendable with respect to its associated outer pole;

six rigid collars, each collar having an inner radial extent with a decreasing diameter, each collar threadably coupled about an upper end of a separate outer pole and its associated inner pole, whereby tightening a collar occurs as the diameter around the upper end decreases as the collar is coupled thereon allowing the collar to set the extension of an inner pole with respect to its outer pole and loosening a collar allows adjustment of the inner pole with respect to its associated outer pole;

a pair of line payer heads, each line payer head coupled to a separate upper end of a separate inner pole, each line payer head further comprising:

a rigid and generally cylindrical top section having a lower surface and a peripheral and outwardly tapered side wall extending upwards therefrom to define an opening;

a rigid and generally circular cover threadably coupled to the top section over the opening to define a first compartment;

a rigid and generally cylindrical bottom section having a lower surface and a peripheral side wall extended upwards therefrom and threadably coupled to the lower surface of the top section to define a second compartment;

a pivot pin centrally disposed in the second compartment having one end coupled to the lower surface of the bottom section and another end extended upwards therefrom;

a spool rotatably disposed about the pivot pin within the second compartment;

an elongated and coiled spring disposed about the pivot pin with the spring having one end coupled to the pivot pin and another end coupled to the spool with the spring adapted for urging the spool into a position such that the radial extension of the spring is minimal;

a lamp coupled to the cover with a portion thereof extended into the first compartment;

a battery disposed within the first compartment and coupled to the lamp with the battery adapted for providing energy for illuminating the lamp;

a switch coupled between the battery and the lamp and extended through the cover with the switch having one orientation for energizing the lamp and another for de-energizing the lamp; and a flasher coupled between the switch and the battery with the flasher adapted for allowing the lamp to be strobed when energized, whereby providing an indicative warning;

four rigid loops, each loop coupled to a separate upper end of four of the inner poles not having a line payer head coupled thereto with each loop adapted for holding a cable therein;

a flexible cable having one end coupled to and wrapped around the spool of one of the line payer heads and another end extended through the line payer head, through the four loops on the inner poles, through the other line payer head, and coupled to its spool such that the inner poles, outer poles, collars, loops, and line payer heads create an extendable barrier, whereby when the cable is extended between the line payer heads and the outer poles are positioned on a generally level surface in a spaced relationship, the barrier is placed in an operable configuration; and a rigid carrying tray having six spaced and aligned holes disposed thereon adapted to receive the lower ends of the outer poles therein to define a stowed configuration for the barrier, the carrying tray further having a pair of handles coupled thereto and extended upwards therefrom for allowing the carrying tray to be transported from one location to another.

2. A portable line barrier comprising:

a plurality of telescopically extendable poles;

a pair of line payer heads, each line payer head coupled to a separate pole, each line payer head further comprising;

a container having a hollow interior and a closeable opening for allowing access to the interior; and a spool disposed within the interior of the container and rotatably coupled thereto;

a plurality of loops with each loop coupled to separate pole not having a line payer head coupled thereto with each loop adapted for holding cable therein;

a flexible cable having one end coupled to and wrapped around the spool of one of the line payer heads and another end extended through the loops of the poles and coupled to and wrapped around the spool of the other line payer head such that the poles, line payer heads, and loops create an extendable barrier, whereby when the cable is extended between the line payer heads and the poles are positioned on surface in a spaced relationship, the barrier is placed in an operable configuration; and a rigid carrying tray having a plurality of holes disposed thereon adapted to receive the poles therein to define a stowed configuration of the barrier, the carrying tray further having a pair of handles coupled thereto for allowing the carrying tray to be transported form one location to another.

3. The portable line barrier as set forth in claim 2 further including:

a lamp coupled to the container;

a battery disposed within the container and coupled to the lamp with the battery adapted for providing energy for illuminating the lamp;

a switch coupled between the battery and the lamp and extended through the container with the switch having one orientation for energizing the lamp and another for de-energizing the lamp; and flasher circuitry coupled between the switch and the battery with the flasher circuitry adapted for allowing the lamp to be strobed when energized.

* * * * *